US006881888B2

(12) United States Patent
Akazawa et al.

(10) Patent No.: US 6,881,888 B2
(45) Date of Patent: Apr. 19, 2005

(54) WAVEFORM PRODUCTION METHOD AND APPARATUS USING SHOT-TONE-RELATED RENDITION STYLE WAVEFORM

(75) Inventors: Eiji Akazawa, Hamamatsu (JP); Motoichi Tamura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 149 days.

(21) Appl. No.: 10/369,450

(22) Filed: Feb. 18, 2003

(65) Prior Publication Data

US 2003/0154847 A1 Aug. 21, 2003

(30) Foreign Application Priority Data

Feb. 19, 2002 (JP) ..... 2002-041175

(51) Int. Cl.[7] ..... G10H 7/00

(52) U.S. Cl. ..... 84/604; 84/609; 84/615; 84/622; 84/625

(58) Field of Search ..... 84/602–607, 609, 84/615, 622–633, 649, 653, 659–665

(56) References Cited

U.S. PATENT DOCUMENTS

| | | | | |
|---|---|---|---|---|
| 6,150,598 | A | 11/2000 | Suzuki et al. | |
| 6,284,964 | B1 | 9/2001 | Suzuki et al. | |
| 6,362,411 | B1 * | 3/2002 | Suzuki et al. | 84/626 |
| 6,365,817 | B1 * | 4/2002 | Suzuki et al. | 84/603 |
| 6,365,818 | B1 | 4/2002 | Suzuki | |
| 6,403,871 | B1 * | 6/2002 | Shimizu et al. | 84/622 |
| 6,486,389 | B1 * | 11/2002 | Suzuki et al. | 84/603 |
| 6,531,652 | B1 * | 3/2003 | Suzuki et al. | 84/626 |
| 6,584,442 | B1 * | 6/2003 | Suzuki et al. | 704/500 |
| 6,687,674 | B1 * | 2/2004 | Suzuki et al. | 704/268 |
| 6,727,420 | B1 * | 4/2004 | Suzuki et al. | 84/604 |
| 6,798,427 | B1 * | 9/2004 | Suzuki et al. | 345/763 |
| 2002/0143545 | A1 | 10/2002 | Tamura et al. | |
| 2003/0084778 | A1 * | 5/2003 | Suzuki et al. | 84/604 |
| 2003/0094090 | A1 * | 5/2003 | Tamura et al. | 84/602 |
| 2003/0154847 | A1 * | 8/2003 | Akazawa et al. | 84/627 |
| 2003/0177892 | A1 * | 9/2003 | Akazawa et al. | 84/616 |
| 2004/0035284 | A1 * | 2/2004 | Tamura et al. | 84/634 |
| 2004/0055449 | A1 * | 3/2004 | Akazawa et al. | 84/626 |

FOREIGN PATENT DOCUMENTS

| | | |
|---|---|---|
| EP | 1 087 368 | 3/2001 |
| EP | 1 087 369 | 3/2001 |
| EP | 1 087 370 | 3/2001 |

OTHER PUBLICATIONS

U.S. Appl. No. 09/667,955, filed Sep. 22, 2000.
U.S. Appl. No. 09/667,945, filed Sep. 22, 2000.
U.S. Appl. No. 09/668,726 filed Sep. 22, 2000.

* cited by examiner

*Primary Examiner*—Marlon Fletcher
(74) *Attorney, Agent, or Firm*—Morrison & Foerster LLP

(57) ABSTRACT

In a memory, there are prestored shot-tone-related rendition style modules, each integrally including attack and release waveforms, in addition to attack-, release-, body- and joint-related rendition style modules. When two or more rendition style modules are to be time-serially combined, a shot-tone-related rendition style module is selectively assigned to a tone corresponding to a predetermined rendition style and allotted to a time axis. Then, a waveform is synthesized in accordance with the thus-allotted shot-tone-related rendition style module. Such arrangements permit production, with ample controllability, a high-quality waveform of a characteristic tone faithfully reflecting a predetermined rendition style having rendition styles of attack and release portions closely related each other, which was hitherto impossible.

14 Claims, 6 Drawing Sheets

WAVEFORM PRODUCTION METHOD AND APPARATUS USING SHOT-TONE-RELATED RENDITION STYLE WAVEFORM

BACKGROUND OF THE INVENTION

The present invention relates generally to waveform production apparatus and methods for producing waveforms of musical tones, voices or other desired sounds by connecting and synthesizing waveforms read out from a waveform memory or the like. More particularly, the present invention relates to an improved waveform production apparatus and method, which, by preparing in advance not only normal style-of rendition (hereinafter referred to as "rendition style") modules, such as attack-, release-, body- and joint-related rendition style modules, to be used for generating normal sounds but also shot-tone-related rendition style modules to be used for producing special sounds that heretofore could not be reproduced faithfully, can more faithfully express or reproduce color (timbre) variations effected by various rendition styles or various articulation peculiar to natural musical instruments. Note that the present invention is applicable extensively to all fields of equipment, apparatus or methods capable of producing waveforms of musical tones, voices or other desired sounds, such as automatic performance apparatus, computers, electronic game apparatus or other types of multimedia equipment, not to mention ordinary electronic musical instruments. It should also be appreciated that, in this specification, the term "tone" is used to embrace a voice or other sound than a musical tone and similarly the terms "tone waveform" are used to embrace a waveform of a voice or any other desired sound, rather than to refer to a waveform of a musical tone alone.

The so-called "waveform memory readout" technique has been well known in the art, in accordance with which waveform data (i.e., waveform sample data), encoded by a desired encoding scheme, such as the PCM (Pulse Code Modulation), DPCM (Differential PCM) or ADPCM (Adaptive Differential PCM), are prestored in a waveform memory of an electronic musical instrument so that a tone waveform can be produced by reading out an appropriately-selected set of waveform data from the waveform memory at a rate corresponding to a desired tone pitch. There have been known various types of waveform memory readout techniques. Most of the known waveform memory readout techniques are intended to produce a waveform from the beginning to end of each tone to be generated. Among various examples of the known waveform memory readout techniques is one that prestores waveform data of an entire waveform from the beginning to end of a tone to be generated, and one that prestores waveform data of a full waveform for an attack portion or the like of a tone having complicated variations but prestores a predetermined loop waveform segment for a sustain or other portion having little variations. In this specification, the terms "loop waveform" are used to refer to a waveform to be read out in a repeated (looped) fashion.

In the waveform memory readout techniques prestoring waveform data of an entire waveform from the beginning to end of a tone to be generated or waveform data of a full waveform for an attack portion or the like of a tone, there must be prestored a multiplicity of different sets of waveform data corresponding to a variety of rendition styles (or articulation) and thus a great storage capacity is required for storing the multiplicity of sets of waveform data.

Further, although the above-mentioned technique designed to prestore waveform data of an entire waveform can faithfully express tone color (timbre) variations effected by various rendition styles (or articulation) peculiar to a natural musical instrument, it can only reproduce tones just in the same manner as represented by the prestored data, and thus it tends to encounter poor controllability and editability. For example, it has been very difficult for the technique to perform control of waveform characteristics, such as performance-data-based time axis control, of the waveform date corresponding to a desired rendition style or kind of articulation.

To address the above-discussed inconveniences of the conventional techniques, a more sophisticated technique for facilitating realistic reproduction and control of various rendition styles (articulation) peculiar to natural musical instruments has been proposed in Japanese Patent Laid-open Publication No. 2000-122665 and the like; this more sophisticated techniques is commonly known as a "SAEM" (Sound Articulation Element Modeling) technique. According to the SAEM technique, attack-, release-, body- and joint-related rendition style modules are prepared in advance so that a continuous tone waveform can be produced by time-serially combining two or more of the prepared rendition style modules. For example, the SAEM technique can produce a waveform of a tone by applying an attack-related rendition style module to a rise portion (i.e., attack portion) of the tone, a body-related rendition style module to a steady portion of the tone and a release-related rendition style module to a fall portion (i.e., release portion) of the tone and then connecting together waveform data corresponding to these rendition style modules. Note that the joint-related rendition style module is a module to be used to interconnect adjoining tones (or adjoining tone portions) via a desired rendition style.

The conventionally-known SAEM technique can significantly increase variations of rendition styles by variously combining the attack-, release-, body- and joint-related rendition style modules. However, in the case of a characteristic tone, such as a tone having a very short time length or duration (i.e., one-shot waveform) like a staccato performance tone, or a tone ending in glissando immediately after its rise, rendition styles (articulation) of the attack and release portions are closely related to each other, namely, closely influence each other. Because such a characteristic tone integrally includes its attack and release portions and has a very short duration, it will hereinafter be referred to also as a "shot tone". For the reason stated above, it has been very difficult to faithfully reproduce such a characteristic tone by just combining the attack-and release-related rendition style modules to produce a connected waveform. In the first place, for a tone of a very short time length (shot tone), such as a staccato performance tone, which has a very short time interval from the articulation of the attack portion to the articulation of the release portion, it is hardly possible to separately prepare in advance respective rendition style modules for the attack and release portions. Even where the respective rendition style modules for the attack and release portions can be separately prepared in advance through some extra effort, such rendition style modules often can not be appropriately used in combination with other kinds of rendition style modules, such as body-related rendition style module, of a normal tone than the shot tone, and therefore it would be meaningless or worthless to bother to prepare such separate rendition style modules for the attack and release portions through extra effort.

Namely, with the conventionally-known SAEM technique, it has been extremely difficult to faithfully reproduce, as a realistic tone, a characteristic shot tone having attack and release portions closely related to, or closely influencing, each other, such as one of a very short time length like a staccato performance tone, or one ending in glissando immediately after its rise.

SUMMARY OF THE INVENTION

In view of the foregoing, it is an object of the present invention to provide a waveform production apparatus and method which can readily produce characteristic tones in a simplified manner and with ample controllability, and particularly a characteristic tone having rendition styles (articulation) faithfully reflected in its attack and release portions, by preparing in advance not only normal rendition style modules, such as attack-, release-, body- and joint-related rendition style modules, to be used for producing normal tones but also shot-tone-related rendition style modules, comprising an integral combination of attack- and release-related rendition style modules, to be used for generation of the characteristic tone different from normal tones.

To accomplish the above-mentioned object, the present invention provides a waveform production apparatus for time-serially combining a plurality of rendition style modules and thereby producing a continuous tone waveform having rendition style characteristics corresponding to the combined rendition style modules, which comprises: a memory storing a plurality of rendition style modules, the memory storing at least a shot-tone-related rendition style module integrally including characteristics of an attack portion and release portion in association with a predetermined rendition style; and a processor coupled with the memory. In the present invention, the processor is adapted to: select the shot-tone-related rendition style module from the memory, in order to produce a tone waveform having a characteristic of the predetermined rendition style; read out, from the memory, two or more rendition style modules including the selected shot-tone-related rendition style module and allot the read-out rendition style modules to a time axis; and then produce a continuous tone waveform on the basis of the rendition style modules thus allotted to the time axis.

According to the present invention, for production of a tone waveform having a characteristic of a predetermined rendition style, the shot-tone-related rendition style module is allocated so that waveform data corresponding to the allotted shot-tone-related rendition style module are synthesized to produce the tone waveform. Thus, the present invention can produce a high-quality waveform having a predetermined rendition style faithfully reflected therein. More specifically, by synthesizing the waveform data corresponding to the shot-tone-related rendition style module, the present invention can readily produce a waveform of a special tone having rendition styles of attack and release portions closely related to each other. Namely, by prestoring the shot-tone-related rendition style module and selectively allocating, at the time of time-serially combining a plurality of rendition style modules, the shot-tone-related rendition style module for production of a tone waveform of the predetermined rendition style production, the present invention can produce, in a simplified manner and with ample controllability, a high-quality waveform of a characteristic tone reflecting a predetermined rendition style having rendition styles of attack and release portions closely related each other, which was hitherto impossible to produce.

According to another aspect of the present invention, there is provided a waveform production apparatus for time-serially combining a plurality of rendition style modules and thereby producing a continuous tone waveform having rendition style characteristics corresponding to the combined rendition style modules, which comprises: a memory storing a plurality of rendition style modules, the memory storing at least a shot-tone-related rendition style module integrally including characteristics of an attack portion and release portion, an attack-related rendition style module having a characteristic of an attack portion and a release-related rendition style module; and a processor coupled with the memory. In the present invention, the processor is adapted to: select whether the shot-tone-related rendition style module should be used or a combination of the attack-related rendition style module and release-related rendition style module should be used, in order to produce a tone waveform having an attach portion and release portion; read out, from the memory, two or more rendition style modules including the selected rendition style module and allot the read-out rendition style modules to a time axis; and produce a continuous tone waveform on the basis of the rendition style modules allotted to the time axis. With such arrangements, a desired selection can be made between the use of the shot-tone-related rendition style module and the use of the combination of the attack-related rendition style module and release-related rendition style module, and thus the present invention can readily synthesize a high-quality waveform accurately corresponding to rendition style characteristics of a tone to be generated.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which.

DETAILED DESCRIPTION OF THE PREFERRED EMBODIMENTS

Figure 1:
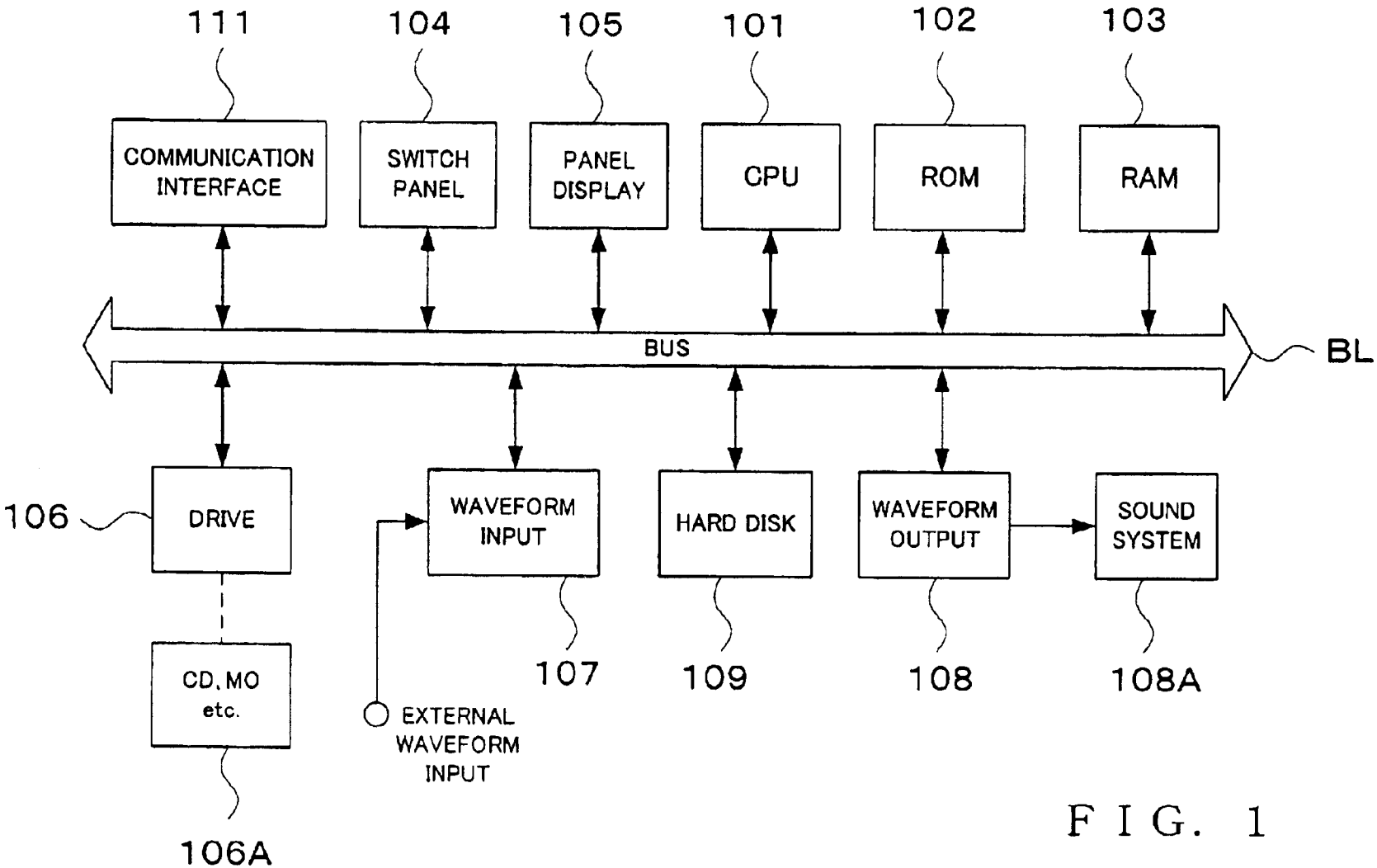
FIG. 1 is a block diagram showing an exemplary hardware organization of a waveform production apparatus in accordance with an embodiment of the present invention.

FIG. 1 is a block diagram showing an exemplary hardware organization of a waveform production apparatus in accordance with an embodiment of the present invention. The waveform production apparatus illustrated here is implemented using a computer, and predetermined waveform production processing is carried out by the computer executing predetermined waveform producing programs (software). Of course, the waveform production processing may be implemented by microprograms to be executed by a DSP (Digital Signal Processor), rather than by such computer software. Also, the waveform production processing of the present invention may be implemented by a dedicated hardware apparatus that includes discrete circuits or integrated or large-scale integrated circuit. Further, the waveform production apparatus of the present invention may be implemented as an electronic musical instrument, karaoke apparatus, electronic game apparatus, multimedia-related apparatus, personal computer or any other desired form of product. It should be appreciated that, in this specification, the term "tone" is used to embrace a voice or other sound than a musical tone and similarly the terms "tone waveform" are used to embrace a waveform of a voice or any other desired sound, rather than to refer to a waveform of a musical tone alone.

Note that, while the waveform production apparatus of the present invention may include other hardware than the above-mentioned, it will hereinafter be described in relation to a case where only necessary minimum resources are employed.

In FIG. 1, the waveform production apparatus of the present invention includes a CPU (Central Processing Unit) 101 functioning as a main control section of the computer, to which are connected, via a bus (e.g., data and address bus) BL, a ROM (Read-Only Memory) 102, a RAM (Random Access Memory) 103, a switch panel 104, a panel display unit 105, a drive 106, a waveform input section 107, a waveform output section 108, a hard disk 109 and a communication interface 111. The CPU 101 carries out various processes, such as a "rendition-style-waveform database creation process" (not shown) and a "waveform production processing" (see FIG. 4), on the basis of predetermined programs, as will be later described in detail. These programs are supplied, for example, from a network via the communication interface 111 or from an external storage medium 106A, such as a flexible disk (FD), compact disk (CD-ROM or CD-RAM), magneto-optical disk (MO) or digital versatile disk (DVD), and then stored in the hard disk 109. For execution of a desired one of the programs, the desired program is loaded from the hard disk 109 into the RAM 103; in an alternative, the programs may be prestored in the ROM 102.

The ROM 102 stores therein various programs and various data to be executed or referred to by the CPU 101. The RAM 103 is used as a working memory for temporarily storing various performance-related information and various data generated as the CPU 101 executes the programs, or as a memory for storing a currently-executed program and data related to the program. Predetermined address regions of the RAM 103 are allocated to various functions and used as various registers, flags, tables, memories, etc. The switch panel 104 includes various operators for entering various setting information, such as performance conditions and waveform producing conditions, editing waveform data etc. and entering various other information. The switch panel 104 may be, for example, in the form of a ten-button keypad for inputting numerical value data, keyboard for inputting character data and/or panel switches for entering conditions to select a shot-tone-related rendition style module. The switch panel 104 may also include other operators for selecting, setting and controlling a pitch, color, effect, etc. of a tone to be generated. The panel display unit 105 comprises a liquid crystal display (LCD), CRT (Cathode Ray Tube) and/or the like, which visually displays various information entered via the switch panel 104, sampled waveform data, selected shot-tone-related rendition style module, etc.

The waveform input section 107 contains an A/D converter for converting an analog tone signal, introduced via an external waveform input device such as a microphone, into digital data (waveform data sampling), and then inputs the thus-sampled digital waveform data into the RAM 103 or hard disk 109. Rendition style waveform database can be created on the basis of such input waveform data. Namely, the input waveform data can be used as original waveform data (hereinafter referred to as a "rendition style module" that is used as a material of a waveform to be produced). The rendition-style-waveform database creation process (not shown) executed by the CPU 101 is designed to perform a predetermined component separation operation and frequency analysis on each analog tone signal input via the waveform input section 107 and stores resultant original waveform data in the rendition style waveform database comprising the hard disk 109 or the like. That is, the original waveform of each tone, performed with various rendition styles peculiar to a natural musical instrument and input via the waveform input section 107, is divided or segmented into partial (tone-portion-specific) characteristic waveforms, such as partial waveforms of nonsteady-steady portions, like attack, release and joint portions, of the tone and a representative partial waveform of a steady-state portion, like a body portion, of the tone. Each of the thus-segmented partial waveforms is subjected to Fast Fourier Transform (FFT) for division into components, such as harmonic and nonharmonic components. In addition, characteristics of various waveform factors or elements, such as a waveform shape, pitch and amplitude, are extracted from each of the harmonic and nonharmonic components; here, extraction is made of a "waveform shape" (Timbre) element representing only extracted characteristics of a waveform shape normalized in pitch and amplitude, a "pitch" element representing extracted characteristics of a pitch variation relative to a predetermined reference pitch, and an "amplitude" element representing extracted characteristics of an amplitude envelope. Thus, the partial waveforms are stored in the rendition style waveform database after being subjected to hierarchical data compression performed for each of the waveform components and waveform elements. Such original waveform data (rendition style modules) will be later described in detail. Note that the rendition style waveform database may be provided in other than the computer hard disk of the waveform production apparatus, such as a server site connected to the computer of the waveform production apparatus via a network or may be provided in a portable storage medium like a CD or DVD.

Waveform data of each tone signal, generated through the waveform production processing executed by the CPU 101, are delivered via the bus BL to the waveform output section 108 and stored in a buffer as appropriate. The waveform output section 108 outputs the buffered waveform data at a predetermined output sampling frequency, and the thus-output waveform data are passed to a sound system 108A after D/A conversion so that the corresponding tone signal is audibly reproduced via the sound system 108A. The hard disk 109 stores a plurality of types of performance-related data, such as original waveform data (rendition style modules) and various other data to be used for synthesizing waveforms corresponding rendition styles, data relating to control of various programs executed by the CPU 101, etc.

The drive 106 functions to drive a removable disk (external storage medium 106A) for storing original waveform data (rendition style module), data to be used for synthesizing a waveform corresponding to a rendition style, a plurality of types of performance-related data such as tone color data composed of various kinds of tone color parameters and control-related data such as those of various programs to be executed by the CPU 101. It should also be appreciated that the external storage medium 106A to be driven by the drive 106 may be any one of various known removable-type media, such as a flexible disk (FD), compact disk (CD-ROM or CD-RAM), magneto-optical (MO) disk and digital versatile disk (DVD) or semiconductor memory. Stored contents (control program) of the external storage medium 106A set in the drive 106 may be loaded directly into the RAM 103, without being first loaded into the hard disk 109. Such an approach of supplying a desired program via the external storage medium 106A or via a communication network is very advantageous in that it can greatly facilitate version upgrade of the control program, addition of a new control program, etc.

Further, the communication interface 111 is connected to a communication network, such as a LAN (Local Area Network), the Internet or telephone line network, via which it may be connected to a desired sever computer or the like (not shown) so as to input a control program and original waveform data (rendition style module) or performance information to the waveform production apparatus. Namely, in a case where a particular control program and waveform data are not contained in the ROM 102 or hard disk 109 of the waveform production apparatus, these control program and waveform data can be downloaded from the server computer via the communication interface 111 to the waveform production apparatus. In such a case, the waveform production apparatus of the present invention, which is a "client", sends a command to request the server computer to download the control program and waveform data by way of the communication interface 111 and communication network. In response to the command from the client, the server computer delivers the requested control program and waveform data to the waveform production apparatus via the communication network. The waveform production apparatus receives the control program and waveform data from the server computer via the communication network and communication interface 111 and accumulatively stores them into the hard disk 109. In this way, the necessary downloading of the control program and waveform data is completed. It should be obvious that the waveform production apparatus may further include a MIDI interface so as to receive MIDI performance information. It should also be obvious that a music-performing keyboard and performance-operating equipment may be connected to the bus BL so that performance information can be supplied to the waveform production apparatus by an actual real-time performance. Of course, the external storage medium 106A containing performance information of a desired music piece may be used to supply the performance information of the desired music piece to the waveform production apparatus.

In the rendition style waveform database constructed using the above-mentioned hard disk 109 or other suitable storage medium, there are stored a multiplicity of original waveform data sets (rendition style modules) for reproducing waveforms corresponding to various rendition styles (or various articulation), as well as data groups pertaining to the rendition style modules. Note that each of the rendition style modules is a rendition style waveform unit that can be processed as a single data block in a rendition style waveform synthesis system; in other words, the rendition style module is a rendition style waveform unit that can be processed as a single event. For example, the rendition style modules include those defined in accordance with characteristics of rendition styles of performance tones, those defined in correspondence with partial sections, such as attack, body and release portions, of tones, those defined in correspondence with joint sections between successive tones such as a slur, those defined in correspondence with special performance sections, such as a vibrato and staccato, and those defined in correspondence with a plurality of notes like musical phrases.

In the instant embodiment, the rendition style modules can be classified into several major types on the basis of characteristics of rendition styles, timewise segments or sections of a performance, etc. For example, the following are nine major types of rendition style modules classified in the instant embodiment:

1) "Normal Entrance": This is a rendition style module representative of a rise portion (i.e., attack portion) of a tone from a silent state;

2) "Normal Finish": This is a rendition style module representative of a fall portion (i.e., release portion) of a tone leading to a silent state;

3) "Normal Joint": This is a rendition style module representative of a joint portion interconnecting two successive tones with no intervening silent state;

4) "Normal Short Body": This is a shot-tone-related rendition style module representative of a short non-vibrato-imparted portion of a tone in between the rise and fall portions (i.e., non-vibrato-imparted body portion of the tone);

5) "Vibrato Body": This is a rendition style module representative of a vibrato-imparted portion of a tone in between the rise and fall portions (i.e., vibrato-imparted body portion of the tone);

6) "Staccato Shot": This is a rendition style module representative of the whole of a staccato-performed tone (i.e., staccato shot) that includes both a rise portion (i.e., attack portion) following a silent state and a fall portion (i.e., release portion) leading to a silent state and that has a shorter length or duration than a normal tone;

7) "Bounce Shot": This is a rendition style module representative of the whole of a tone that is generated, at or near the end of a staccato performance, to give a bouncing feel, that includes both a rise portion (i.e., attack portion) following a silent state and a fall portion (i.e., release portion) leading to a silent state and that bounces to a greater degree than a normal staccato-performed tone (i.e., staccato shot);

8) "Gliss-down Shot": This is a rendition style module representative of the whole of a tone that includes both a rise portion (i.e., attack portion) following a silent state and a fall portion (i.e., release portion) leading to a silent state and that rapidly varies in pitch in downward glissando immediately after the rise; and 9) "Gliss-up/down Shot": This is a rendition style module representative of the whole of a tone that includes both a rise portion (i.e., attack portion) following a silent state and a fall portion (i.e., release portion) leading to a silent state and that rapidly varies in pitch in upward glissando immediately after the rise and then falls in downward glissando.

It should be appreciated here that the classification into the above nine rendition style module types is just illustrative, and the classification of the rendition style modules may be made in any other suitable manner; for example, the rendition style modules may be classified into more than nine types. Further, the rendition style modules may also be classified according to original tone sources, such as musical instruments.

Further, in the instant embodiment, the data of each rendition style waveform corresponding to one rendition style module are stored in the database as a data set of a plurality of waveform-constituting factors or elements, rather than being stored merely as originally input; each of the waveform-constituting elements will hereinafter be called a vector. As an example, each rendition style module includes the following vectors. Note that "harmonic" and "nonharmonic" components are defined here by separating the original rendition style waveform in question into a waveform segment having a pitch-harmonious component (harmonic component) and the remaining waveform segment having a non-pitch-harmonious component (nonharmonic component).

1) Waveform shape (timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope extracted from among the waveform-constituting elements of the harmonic component.

3) Pitch vector of the harmonic component: This vector represents a characteristic of a pitch extracted from among the waveform-constituting elements of the harmonic component; for example, it represents a characteristic of time-wise pitch fluctuation relative to a given reference pitch.

4) Waveform shape (timbre) vector of the nonharmonic component: This vector represents only a characteristic of a waveform shape (noise-like waveform shape) extracted from among the waveform-constituting elements of the nonharmonic component and normalized in amplitude.

5) Amplitude vector of the nonharmonic component: This vector represents a characteristic of an amplitude envelope extracted from among the waveform-constituting elements of the nonharmonic component.

The rendition style module may include one or more other types of vectors, such as a time vector indicative of a time-axial progression of the waveform, although not specifically described here.

For synthesis of a rendition style waveform, waveforms or envelopes corresponding to various constituent elements of the rendition style waveform are constructed along a reproduction time axis of a performance tone by applying appropriate processing to these vector data in accordance with control data and arranging or allotting the thus-processed vector data on or to the time axis and then carrying out a predetermined waveform synthesis process on the basis of the vector data allotted to the time axis. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Figure 2:
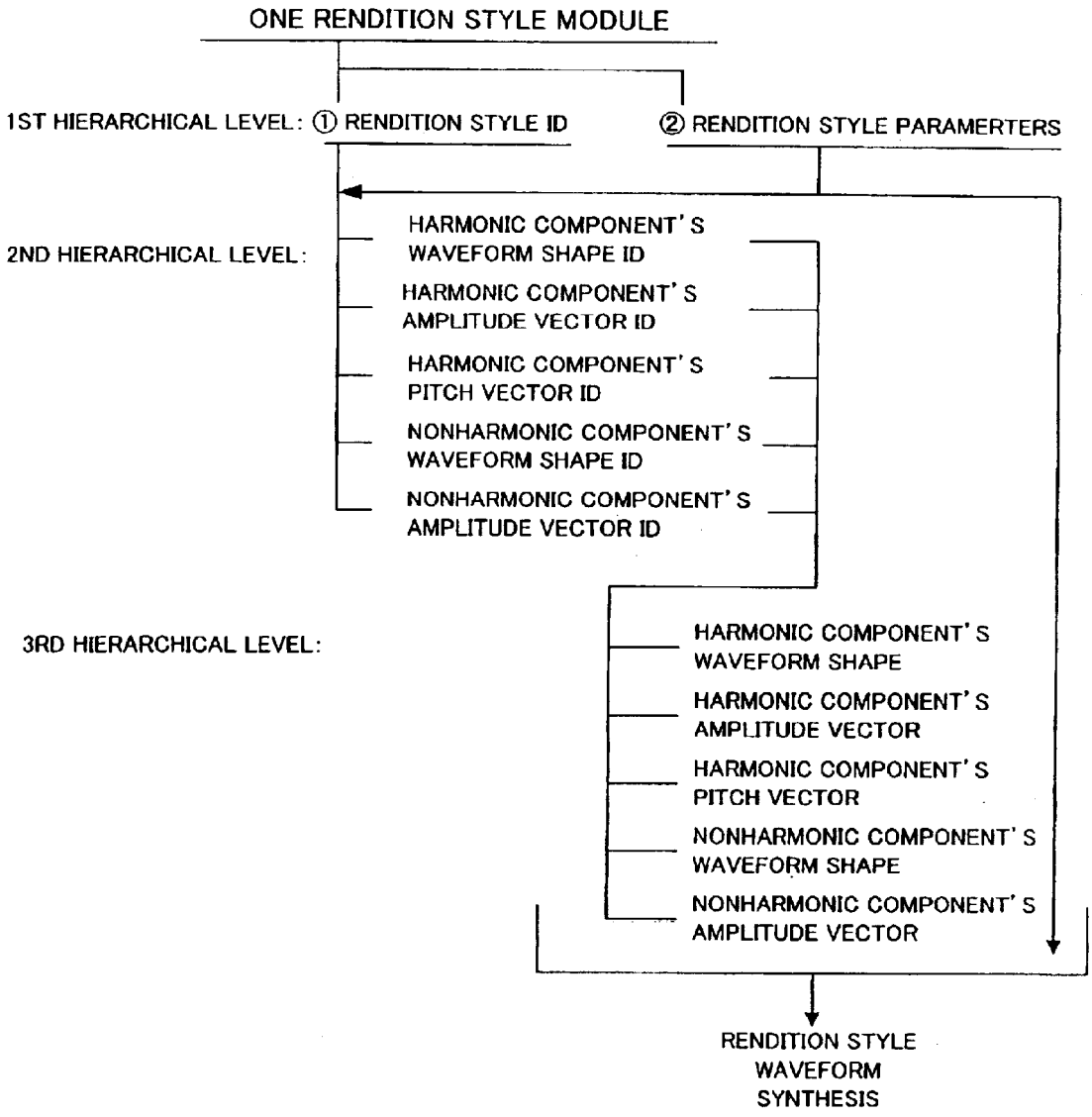
FIG. 2 is a conceptual diagram explanatory of an exemplary data format of a shot-tone-related rendition style module.

The following paragraphs describe an exemplary data format of the rendition style modules, representatively in relation to a shot-tone-related rendition style module. FIG. 2 is a conceptual diagram explanatory of the data format of the shot-tone-related rendition style module.

As an example, each shot-tone-related rendition style module can be identified or specified via a hierarchical data organization as illustratively shown in FIG. 2. At a first hierarchical level of the data organization of FIG. 2, the shot-tone-related rendition style module is specified by a combination of "rendition style ID (identification information)" and "rendition style parameters". The "rendition style ID" is information uniquely identifying the rendition style module and can function as one piece of information for reading out necessary vector data from the database. The "rendition style IDs" at the first hierarchical level can be classified, for example, according to combinations of "musical instrument information" and "module part name". Each piece of the "musical instrument information" represents a name of a musical instrument to which the shot-tone-related rendition style module in question is applied, such as a name of a brass instrument like a trumpet, trombone or tuba. The "module part name" is information indicative of a particular type, such as "gliss-down shot" or "staccato shot", of the shot-tone-related rendition style module along with a character thereof. Such "musical instrument information" and "module part name" may be included in the "rendition style ID" information. Alternatively, the "musical instrument information" and "module part name" may be added to the "rendition style ID" in such a manner that a user is allowed to know, from the "musical instrument information" and "module part name", the character of the shot-tone-related rendition style module to which the rendition style ID pertains.

The "rendition style parameters" are intended to control a time length and level of the waveform represented by the shot-tone-related rendition style module, and they may include one or more kinds of parameters differing from each other depending on the character of the shot-tone-related rendition style module. For example, in the case of a given rendition style module specifiable by a combination of musical instrument information and module part name, "Trumpet[Glissando Shot]", the rendition style parameters may include different kinds of parameters, such as an absolute tone pitch and dynamics at the beginning of generation of a tone and a time length and pitch variation width of the glissando portion. In the case of another rendition style module specifiable by a combination of musical instrument information and module part name, "Trumpet[Staccato Shot]", the rendition style parameters may include different kinds of parameters, such as an absolute tone pitch and dynamics at the beginning of generation of a tone, a time length from the start (note-on timing) to end of the staccato shot and a particular place of the tone in order of staccato performance tones. The "rendition style parameters" may be prestored in memory or the like along with the corresponding rendition style IDs or may be entered by user's input operation, or existing parameters may be modified via user operation to thereby provide such rendition style parameters. Further, in a situation where only the rendition style ID has been supplied with no rendition style parameter given at the time of reproduction of a rendition style waveform, standard rendition style parameters for the supplied rendition style ID may be automatically imparted. Furthermore, suitable parameters may be automatically imparted in the course of processing.

The data at the second hierarchical level of FIG. 2 comprise data of vector IDs each specifiable by the rendition style ID and other data. The rendition style waveform database includes a table or memory called a "rendition style table". In the rendition style table, there are prestored, in association with the rendition style IDs, identification information (i.e., vector IDs) of a plurality of waveform-constituting elements, i.e. vectors, for constructing shot-tone-related rendition style modules represented by the respective rendition style IDs. Namely, data of desired vector IDs and the like can be obtained by consulting the rendition style table in accordance with the rendition style ID. At that time, a combination of the vector IDs to be read out may be varied in accordance with a rendition style parameter value. Note that the data of the second hierarchical level stored in the rendition style table may include other necessary data in addition to the data of the vector IDs. For example, the rendition style table may include, as the other necessary data, data indicative of numbers of selected representative sample points to be modified in a train of samples (hereinafter called a "train of representative sample point numbers"). Because data of an envelope waveform shape, such as amplitude vector or pitch vector data, can reproduce the waveform shape if only they contain data indicative of several representative sample points, it is not necessary to prestore all data of the envelope waveform shape as a template, and it suffices to just prestore only the data of the train of representative sample point numbers. Hereinafter, the data of the train of representative sample point numbers will also be called "Shape" data. The rendition style table may further include information, such as start and end time positions of the vector data of the individual waveform-constituting elements, i.e. waveform shape element, pitch envelope (pitch envelope) and amplitude element (amplitude envelope). Alternatively, all or some of the data of the time positions and the like may be included in the above-mentioned rendition style parameters; stated differently, some of the rendition style parameters may be stored in the rendition style table along with the corresponding vector IDs.

Further, the data at the third hierarchical level of FIG. 2 comprise vector data specifiable by the corresponding vector IDs. The rendition style database also includes a memory called a "code book", in which specific vector data (e.g., templates of Timbre waveform shapes) are prestored in association with the vector IDs. Namely, specific vector data can be read out from the code book in accordance with the vector IDs.

The following lines explain an example set of various specific data of a shot-tone-related rendition style module, including data of the vector ID and Shape (train of representative sample point numbers) etc. of the rendition style module prestored in the rendition style:

Data 1: Sampled length of the shot-tone-related rendition style module;

Data 2: Position of note-on timing;

Data 3: Vector ID of the amplitude element of the harmonic component and train of representative sample point numbers;

Data 4: Vector ID of the pitch element of the harmonic component and train of representative sample point numbers;

Data 5: Vector ID of the waveform shape (Timbre) element of the harmonic component;

Data 6: Vector ID of the amplitude element of the nonharmonic component and train of representative sample point numbers;

Data 7: Vector ID of the waveform shape (Timbre) element of the nonharmonic component;

Data 8: Start position of a block of the waveform shape (Timbre) element of the harmonic component;

Data 9: End position of a block of the waveform shape (Timbre) element of the harmonic component;

Data 10: Start position of a loop portion of the waveform shape (Timbre) element of the harmonic component;

Data 11: Start position of a block of the waveform shape (Timbre) element of the nonharmonic component; and Data 12: End position of the waveform shape (Timbre) element of the nonharmonic component.

Data 1–Data 12 mentioned above will be explained more fully below in greater detail with reference to FIG. 3.

Figure 3:
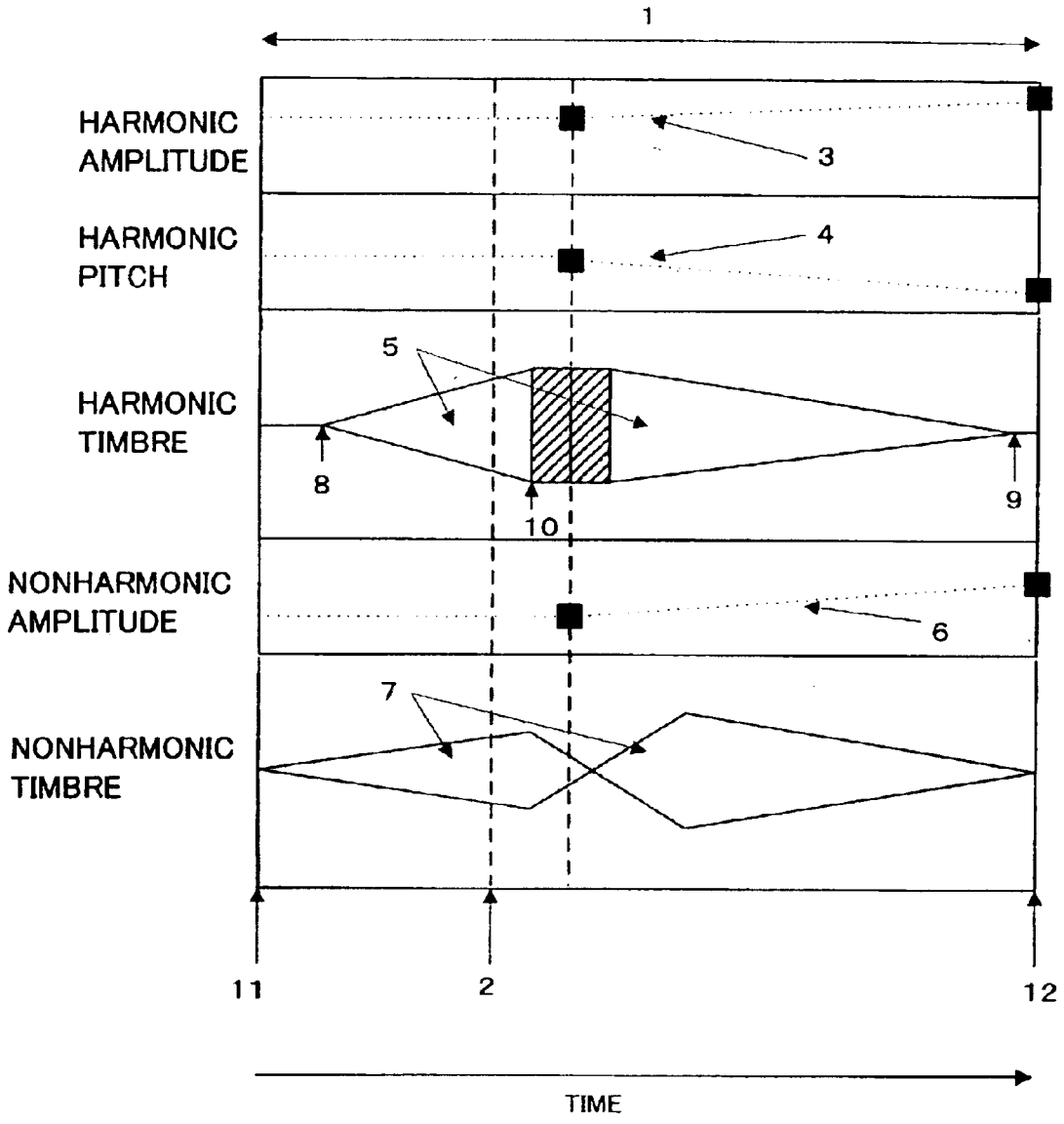
FIG. 3 is a diagram schematically showing examples of various components and elements that constitute an actual waveform section corresponding to a shot-tone-related rendition style module.

FIG. 3 is a diagram schematically illustrating various waveform components and elements constituting an actual waveform section corresponding to the shot-tone-related rendition style module in question. From the top to bottom of FIG. 3, there are shown the amplitude element, pitch element and waveform shape (Timbre) element of the harmonic component, and the amplitude element and waveform shape (Timbre) element of the nonharmonic component which have been detected from the waveform section. Note that numeral values in the figure correspond to the numbers of the above-mentioned data (Data 1–Data 12).

More specifically, numerical value "1" (Data 1) represents the sampled length of the waveform section (length of the waveform section) corresponding to the shot-tone-related rendition style module, which corresponds, for example, to the total time length of the externally-input original waveform of a tone from which the rendition style module in question is derived. Numerical value "2" (Data 2) represents the position of the note-on timing, which can be variably set at any time position of the shot-tone-related rendition style module. Although, in principle, sounding of the performance tone based on the waveform is initiated at the position of the note-on timing, the rise start point of the waveform component may sometimes precede the note-on timing depending on the nature of a particular rendition style such as a staccato performance. For instance, in the case of a brass instrument such as a trumpet, breathing is normally initiated prior to actual sounding, and thus this data is suitable for accurately simulating a beginning portion of the rendition style waveform prior to the actual sounding.

Numerical value "3" (Data 3) represents the vector ID designating the vector data of the amplitude element of the harmonic component ("Harmonic Amplitude") and train of representative sample point numbers stored in the code book; in the figure, two square marks filled in with black indicate two representative sample points. Numerical value "4" (Data 4) represents the vector ID designating the vector data of the pitch element of the harmonic component ("Harmonic Pitch") and train of the representative sample point numbers. Numerical value "6" (Data 6) represents the vector ID designating the vector data of the amplitude element of the nonharmonic component ("Nonharmonic Amplitude") and train of representative sample point numbers. The representative sample point numbers are data to be used for changing/controlling the vector data (comprising a train of a plurality of samples) designated by the vector ID, and designates some of the representative sample points. As the respective time positions (plotted on the horizontal axis of the figure) and levels (plotted on the vertical axis of the figure) for the designated representative sample points are changed or controlled, the other sample points are also changed so that the overall shape of the vector can be changed. For example, the representative sample point numbers represent discrete samples fewer than the total number of the samples; however, the representative sample point numbers may be data indicative of intermediate points between the samples, or data indicative of a plurality of successive samples over a predetermined range. Alternatively, the representative sample point numbers may be data indicative of differences between the sample values, multipliers to be applied to the sample values or the like, rather than the sample values themselves. The shape of each vector data, i.e. shape of the envelope waveform, can be changed by moving the representative sample points along the horizontal axis (time axis) and/or vertical axis (level axis).

Numerical value "5" (Data 5) represents the vector ID designating the vector data of the waveform shape (Timbre) element of the harmonic component ("Harmonic Timbre"). Further, numerical value "7" (Data 7) represents the vector ID designating the vector data of the waveform shape (Timbre) element of the nonharmonic component ("Nonharmonic Timbre"). Numerical value "8" (Data 8) represents the start position of a block of the waveform shape (Timbre) element of the harmonic component. Numerical value "9" (Data 9) represents the end position of the block of the waveform shape (Timbre) element of the harmonic component. Numerical value "10" (Data 10) represents the start position of a loop portion of the waveform shape (Timbre) element of the harmonic component. Namely, a triangle starting at the point denoted by. "8" represents a nonloop waveform segment where characteristic waveform data of the attack portion are stored in succession to form a continuous waveform shape, and the following rectangle starting at the point denoted by "10" represents a loop waveform segment that can be read out in a repeated fashion. Another triangle following the loop waveform segment represents a nonloop waveform segment where characteristic waveform data of the release portion are stored in succession to form a continuous waveform shape. Note that the nonloop waveform segment represents a high-quality waveform segment that is characteristic of the rendition style (articulation) etc. while the loop waveform segment represents a unit waveform of a relatively monotonous tone segment having a single or an appropriate plurality of wave cycles. As seen in FIG. 3, the shot-tone-related rendition style module comprises data representative of the whole of a characteristic tone where the nonloop waveform segment of the attack portion and the nonloop waveform segment of the release portion are included integrally with each other. Numerical value "11" (Data 11) represents the start position of a block of the waveform shape (Timbre) element of the nonharmonic component. Further, numerical value "12" (Data 12) represents the end position of the block of the waveform shape (Timbre) element of the nonharmonic component.

Data 3–Data 7 explained above are identification data indicating the vector data stored in the code book in association with the individual waveform elements, and Data 2 and Data 8–Data 12 are time data for reconstructing the original waveform (i.e., the waveform before the waveform separation or segmentation) on the basis of the vector data. Namely, the shot-tone-related rendition style module comprises data designating the vector data and time data. Using such shot-tone-related rendition style module data stored in the rendition style table, more specifically, waveform producing materials (i.e., vector data) stored in the code book, a desired waveform can be constructed freely. That is, the shot-tone-related rendition style module comprises data representing behavior of a waveform to be produced in accordance with a rendition style or articulation. Note that the shot-tone-related rendition style modules may differ from each other in the type and total number of data included therein and may include other data in addition to the above-mentioned data. For example, the rendition style modules may include data to be used for controlling the time axis of the waveform for stretch/contraction thereof (time-axial stretch/compression control).

Whereas the preceding paragraphs have described the case where each of the shot-tone-related rendition style modules includes all of the fundamental waveform-constituting elements, i.e. waveform shape, pitch and amplitude elements, of the harmonic component and the fundamental waveform constituting elements, waveform shape and amplitude elements, of the nonharmonic component, the present invention is not so limited, and each or some of the shot-tone-related rendition style modules may, of course, include only one of the waveform-constituting elements (waveform shape, pitch and amplitude) of the harmonic component and/or only one of the waveform-constituting elements (waveform shape and amplitude) of the nonharmonic component. For example, each or some of the shot-tone-related rendition style modules may include a selected one of the waveform shape, pitch and amplitude elements of the harmonic component and waveform shape and amplitude elements of the nonharmonic component. In this way, the shot-tone-related rendition style modules can be used freely in a desired combination for each of the waveform components, which is very preferable and advantageous.

Figure 4:
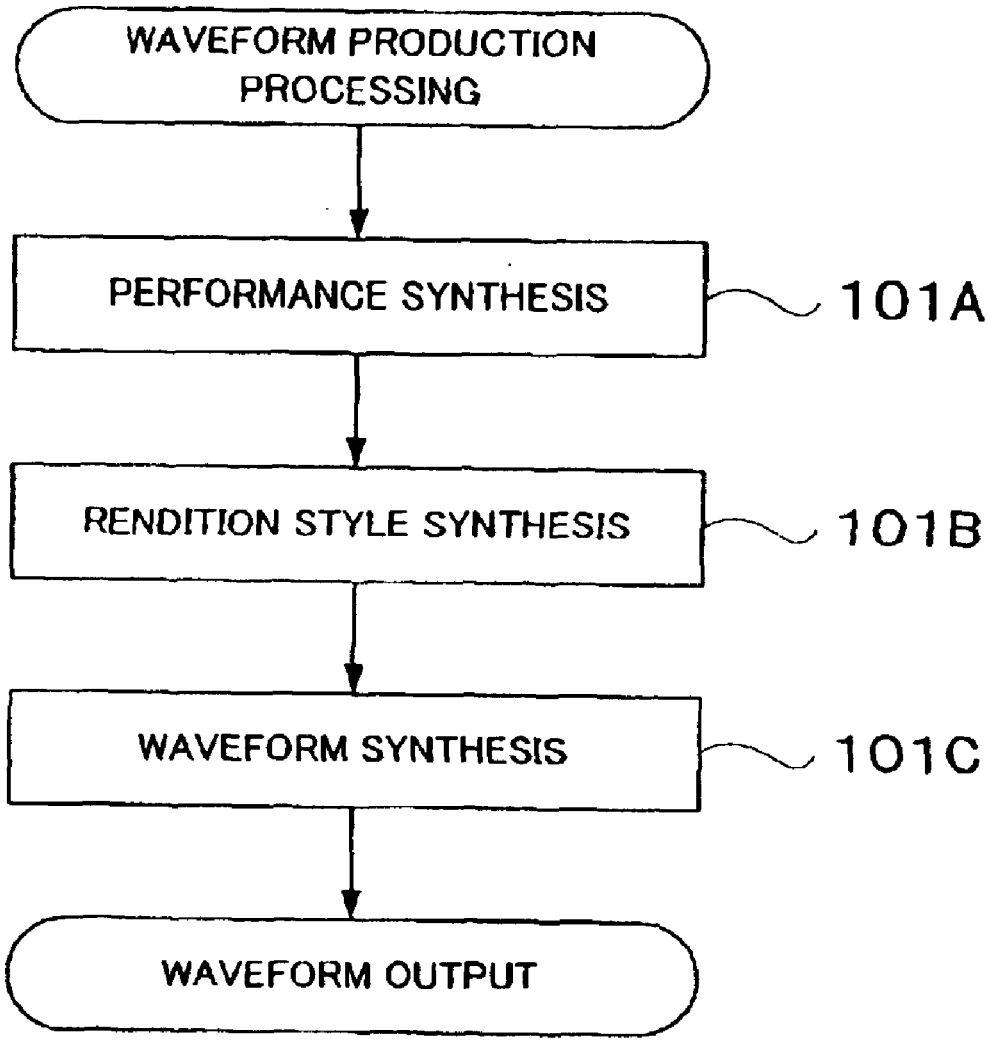
FIG. 4 is a flow chart showing an example of waveform production processing performed by a dedicated hardware apparatus.

In the waveform production apparatus of FIG. 1, an ordinary or normal tone waveform and rendition style waveform are synthesized by the computer executing an ordinary tone generator program, predetermined software program for performing waveform production processing of the invention, etc. The waveform production processing may be performed by a dedicated hardware apparatus rather than by the predetermined software programs. Description will be given about an example of the waveform production processing performed by the dedicated hardware apparatus, with reference to FIG. 4. As shown in FIG. 4, the waveform production processing includes, as its major processing blocks, a performance synthesis section 101A, rendition synthesis section 101B and waveform synthesis section 101C.

The performance synthesis section 101A generates rendition-style designating information (rendition style ID and rendition style parameters) by analyzing musical score information, such as MIDI performance data, of a desired music piece, and thereby supplies the rendition synthesis section 101B with performance data having the thus-generated rendition-style designating information imparted thereto (hereinafter referred to as "rendition-style-imparted musical score information"). Namely, once musical score information of a desired music piece has been received, the performance synthesis section 101A determines, through the analysis of the musical score information and for each performance part in the received musical score information, what kinds of rendition styles are to be used during a performance of the desired music piece. Then, for each of the performance parts in the received musical score information, various rendition style modules, including shot-tone-related rendition style modules, designating the analytically determined rendition style modules are imparted to the corresponding time-serial performance data at points thereof corresponding to particular performance positions of the determined rendition style modules. The above-mentioned analytical determination of the rendition style modules is executed by the CPU 101 using a predetermined musical-score analyzing program. Specifically, in the analytical rendition-style-module determination process, a determination is made, for each predetermined tone, whether a shot-tone-related rendition style module or a combination of normal attack- and release-related rendition style modules is to be used, to thereby automatically select a rendition style module to be used for the predetermined tone. Here, the determination as to which of a shot-tone-related rendition style module and a combination of normal attack- and release-related rendition style modules is to be used is made on the basis of one or more of various determination criteria or conditions.

Figure 5A:
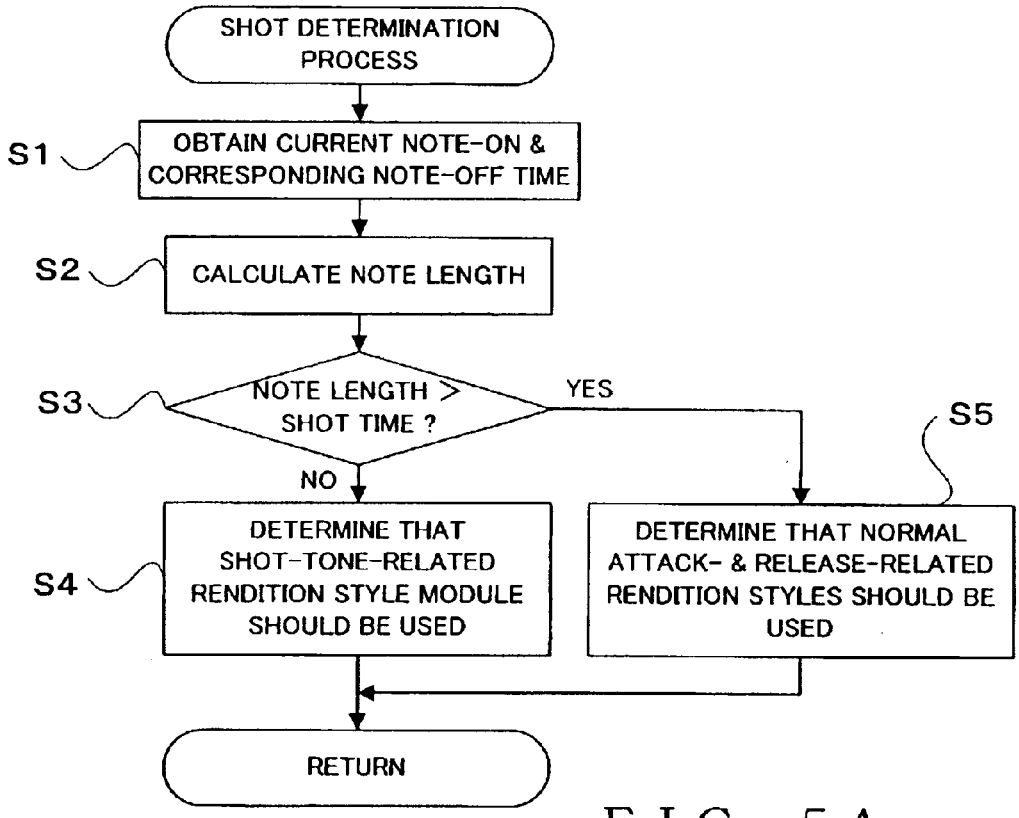
FIGS. 5A and 5B are a flow chart and conceptual diagram, respectively, that are explanatory of an example of a shot determination process performed in the embodiment.
Figure 5B:
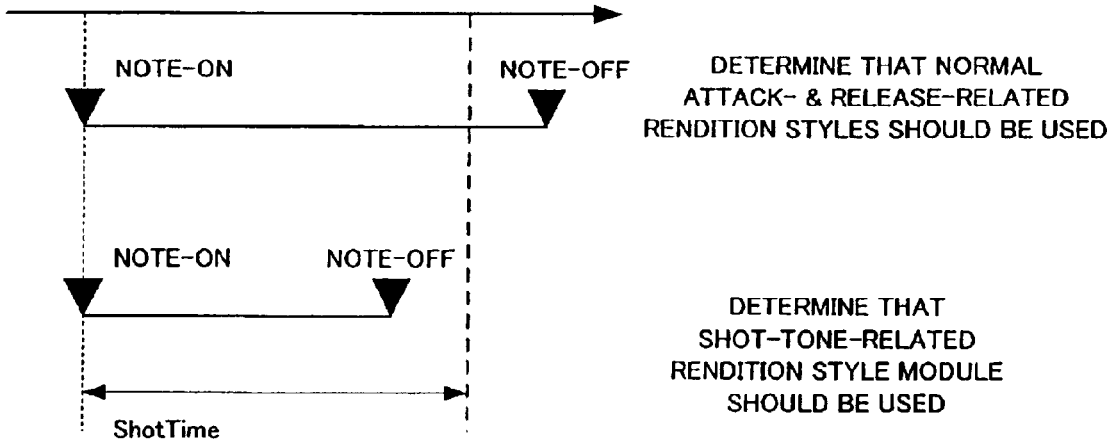

The following paragraphs describe, with reference to conceptual diagrams of FIGS. 5A and 5B, a "shot determination" process for making a determination, for each predetermined tone, as to which of a shot-tone-related rendition style module and a combination of normal attack- and release-related rendition style modules is to be used. FIG. 5A is a flow chart showing an example of the shot determination process, and FIG. 5B is a diagram conceptually explaining a condition for the shot determination.

According to the flow chart of FIG. 5A, a note-on time and corresponding note-off time of a current note is obtained at step S1, and a note length or duration of the tone is calculated, at step S2, by subtracting the thus-obtained note-off time from the note-on time; namely, step S2 calculates a time length from the beginning to end of a performance to be executed of the tone. At next step S3, it is further determined whether or not the calculated note length is greater than a predetermined shot-tone time length. The predetermined shot-tone time length is a time length parameter either prestored in the ROM 102 or appropriately set by the user. If the calculated note length is not greater than the predetermined shot-tone time length as determined at step S3 (NO determination), it is determined, at step S4, that a shot-tone-related rendition style module should be used as a rendition style module for the tone. If, on the other hand, the calculated note length is greater than the predetermined shot-tone time length as determined at step S3 (YES determination), it is determined, at step S5, that a combination of normal attack- and release-related rendition style modules should be used as a rendition style module for the tone. Namely, as illustrated in FIG. 5B, in the case where the time length (i.e., note length) calculated from the note-on and note-off times of the tone is greater than the predetermined shot-tone time length (ShotTime), the tone is represented by a combination of normal attack- and release-related rendition style modules, while, in the case where the calculated time length (i.e., note length) is shorter than the predetermined shot-tone time length (ShotTime), the tone is represented by a shot-tone-related rendition style module.

It should be obvious that, in the case where the calculated time length (i.e., note length) is greater than the predetermined shot-tone time length (ShotTime) (YES determination at step S3), the combination of normal attack- and release-related rendition style modules may be further combined with a body-related rendition style module and joint-related rendition style module, in accordance with the calculated time length and/or note-one time of a succeeding tone, to thereby represent the tone in question. For example, a body-related rendition style module (Vibrato Body), designating a given vibrato rendition style, may be imparted to a position corresponding to a performance time position of a note or phrase where a vibrato is to be imparted, or a joint-related rendition style module (Normal Joint), designating a given slur rendition style, may be imparted to a position corresponding to a performance time position of a note or phrase where a slur is to be imparted. The approach of combining an attack-related, body-related and release-related rendition style modules (and joint-related rendition style module) to represent the whole of a normal tone having a note length greater than the predetermined shot-tone time length is known in the art and thus will not be described here.

Such a given rendition style module (e.g., vibrator or slur rendition style module) may be imparted to any suitable position, such as: a position corresponding to the tone in question (e.g., same position as the note-on event); a position corresponding to an enroute point of the tone in question (for example, a rendition style event may be inserted in an appropriate time position a predetermined time after the note-one time of the tone but prior to occurrence of the note-off event); or a position corresponding to a phrase of a plurality of notes (for example, on-event of a predetermined rendition style may be inserted at the beginning of the phrase and off-event of the rendition style may be inserted at the end of the phrase).

The rendition style module to be imparted includes a rendition style ID indicating a name of any one of various rendition styles, such as a vibrato, slur, staccato, glissando and pitch bend, and rendition style parameters designating a degree of the rendition style. For example, for a staccato performance by a trumpet, the rendition style ID indicates "trumpet (Staccato Shot)", and the rendition style parameters include parameters indicative of an interval, rendition style speed, type of dynamics like Mezzo forte or forte, etc. and sequence parameter indicating whether the rendition style module concerns a single tone or first, second or other tone in a sequence of successively performed tones.

Here, a brief description is made about the sequence parameter indicating whether the rendition style module concerns a single tone or first, second or other tone in a sequence of successively performed tones. The sequence parameter is a parameter that corresponds only to a staccato-shot rendition style module among various shot-tone-related rendition style modules. In the instant embodiment, there are prestored, in the rendition style waveform database, a total of five different kinds of staccato-shot rendition style modules. The five prestored staccato-shot rendition styles are an independent-shot rendition style module to be imparted when a single independent staccato performance is executed, and first- to fourth-shot rendition style modules to be imparted to first-, second-, third- and fourth (or last)-performed tones when four successive staccato performances are executed. Namely, when it is determined, during the analytical determination of rendition style analysis, that a single independent staccato performance is executed with no other staccato shot added before or after the staccato shot in question, the independent-shot rendition style module is used. When, on the other hand, successive staccato performances are executed, the first-shot rendition style module is used for the first-performed tone, second- and third-shot rendition style modules are used alternately for the second- and subsequently-performed tones, other than the last-performed tone, and the fourth-shot rendition style module is used for the last-performed tone. Namely, in the instant embodiment, arrangements are made to prevent a same rendition style module (staccato-shot-tone-related rendition style module) from being used in succession, so that a connection of a plurality of tones forming a musical phrase can be expressed in a natural manner. Note that the sequence parameter may be manually set by the user.

It should also be appreciated that the condition to be used for the shot determination may be a time length of a predetermined note, such as a sixteenth note, in which case, however, the note length has to be calculated on the basis of a performance tempo. Alternatively, the shot determination condition may be any of various other conditions than the predetermined note length, such as time lengths of silent portions between the tone in question and preceding and succeeding tones, and types of rendition style modules to be imparted to a musical phrase including the tone in question or tones preceding and succeeding the tone in question. Further, the shot determination condition, such as the shot time, may be set as desired by the user via the switch panel or the like.

It should also be appreciated that the rendition style module impartment based on the analytical rendition style determination may be carried out by a human operator reading the musical score and performing manual operation, chosen on the basis of the read musical score and his or her musical knowledge, to appropriately select a rendition style module to be imparted. In an alternative, a rendition style module to be used may be selected through a combination of such manual operation and the above-discussed automatic selection.

Further, in a case where the musical score information includes beforehand predetermined information relating to a predetermined rendition style sign or symbol, a rendition style module to be imparted may be selected on the basis of such predetermined information. For example, where the musical score information includes predetermined information relating to a staccato symbol, a "staccato-shot-tone-related" rendition style module may be selected on the basis of the predetermined information.

Referring back to FIG. 4, the rendition style synthesis section 101B makes a reference to the rendition style table on the basis of rendition style designation (rendition style IDs+rendition style parameters) in the rendition-style-imparted musical score information generated by the performance synthesis section 101A, so as to generate a packet stream (also referred to as a vector stream) and vector parameters corresponding to the rendition style designation and rendition style parameters of the packet or vector stream corresponding to the rendition style parameters. The rendition style synthesis section 101B supplies the thus-generated vector parameters to the waveform synthesis section 101C. The data supplied as the packet stream from the rendition style synthesis section 101B to the waveform synthesis section 101C includes: time information of the packets, vector IDs, trains of representative point numbers, etc. for the pitch and amplitude elements; and vector IDs, time information, etc. for the waveform shape (Timbre) element. In generating the packet stream, the rendition style synthesis section 101B calculates times at individual positions on the basis of the time information; namely, it arranges or allots the individual rendition style modules at absolute time positions on the basis of the time information. Specifically, absolute times are calculated from waveform-constituting element data indicative of relative time positions, so that respective timing of the rendition style modules are determined. Then, a "rehearsal process" is carried out for adjusting the individual waveform-constituting element data to smooth connections between the adjoining rendition style modules, i.e. for bringing the representative points in the respective connections of the adjoining (preceding and succeeding) rendition style modules closer to each other and then interconnecting the rendition style modules at these representative points to thereby smooth respective waveform characteristics of the adjoining rendition style modules.

The rehearsal process is intended to achieve, after rendition style synthesis smooth connections in time and level values between the respective start and end points of the time-serially-combined waveform shapes (Timbre), amplitudes and pitches of the harmonic component of the time-serially-combined rendition style modules and between the respective start and end points of the waveform shapes (Timbre) and amplitudes of the nonharmonic component of the time-serially-combined rendition style modules. For this purpose, the rehearsal process, prior to execution of the actual rendition style synthesis, reads out the vector IDs, trains of representative sample point numbers and other parameters by way of a "rehearsal", and performs simulative rendition style synthesis on the basis of the thus read-out information, to thereby set appropriate parameters for controlling the time and level values at the start and end points of the rendition style modules. Thus, the successive rendition style waveforms can be interconnected smoothly, for each of the waveform-constituting elements such as the waveform shape, amplitude and pitch, by the rendition style synthesis section 101B performing a rendition style synthesis process using the parameters having been set on the basis of the rehearsal process. Namely, instead of adjusting or controlling already-synthesized rendition style waveforms or waveform-constituting elements with a view to achieving smooth connections between the rendition style waveforms or waveform-constituting elements, the rendition style synthesis section 101B in the instant embodiment, immediately before actually synthesizing the rendition style waveforms or waveform-constituting elements, performs the "rehearsal process" to simulatively synthesize the rendition style waveforms or waveform-constituting elements and thereby set optimal parameters relating to the time and level values at the start and end points of the rendition style modules. Then, the rendition style synthesis section 101B performs actual synthesis of the rendition style waveforms or waveform-constituting elements using the thus-set optimal parameters, so that the rendition style waveforms or waveform-constituting elements can be connected together smoothly.

However, for the shot-tone-related rendition style modules, the rehearsal process may be performed for the time adjustment alone; that is; the rehearsal operation for the level adjustment may be dispensed with. Namely, because each of the shot-tone-related rendition style modules comprises data pertaining to a single independent short-duration tone and the level connection with other rendition style modules preceding and/or succeeding that rendition style modules is not so important, there is no need to adjust the level in the connecting portion of the shot-tone-related rendition style module so that waveform characteristics relative to the preceding and/or succeeding rendition style modules can be smoothed. The time-adjusting rehearsal operation for the shot-tone-related rendition style module will be later described in detail.

The waveform synthesis section 101C retrieves vector data from the rendition style waveform database in accordance with the packet stream, modifies the vector data in accordance with the vector parameters, and then synthesizes a waveform on the basis of the thus-modified vector data. After that, the waveform production processing is carried out for one or more other performance parts. Here, the terms "other performance part" refer to such a performance part, included in a plurality of performance parts of the musical score, to which normal tone waveform synthesis processing is applied with no rendition style synthesis process executed thereon. For example, for the other performance parts, tone generation processing is executed in accordance with the conventional waveform-memory tone generator scheme. The tone generation processing for the other performance parts may be implemented by a dedicated hardware tone generator, such as a tone generator card that is attachable to an external tone generator unit or computer. To simplify the description, let it be assumed that the tone generation corresponding to rendition styles (or articulation) is executed only for one performance part, although rendition style reproduction may of course be carried out in a plurality of performance parts. The waveform synthesis section 101C outputs a tone waveform produced in the above-described manner.

Figure 6:
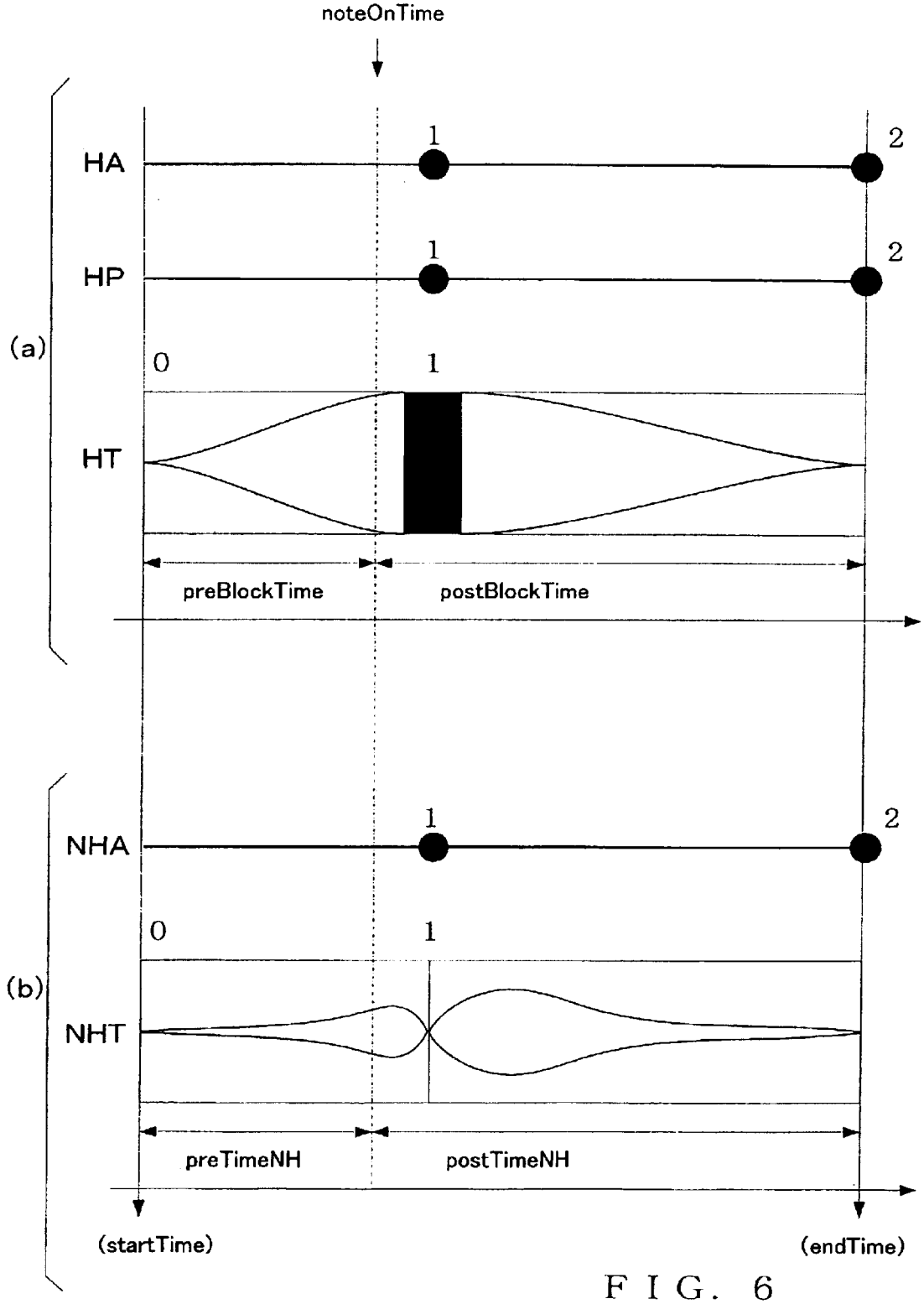
FIG. 6 is a conceptual diagram explanatory of a time-adjusting rehearsal process performed on a staccato-shot-tone-related rendition style module in the embodiment.

As set forth above, the shot-tone-related rendition style module is subjected to the rehearsal process only for time adjustment with other rendition style modules preceding and/or succeeding that rendition style module. Therefore, the following paragraphs describe the time-adjusting rehearsal process performed on the shot-tone-related rendition style module, with reference to FIG. 6. FIG. 6 is a conceptual diagram explanatory of the time-adjusting rehearsal process performed on a staccato-shot-tone-related rendition style module.

Part (a) of FIG. 6 illustratively show various vectors of the harmonic component in the staccato shot tone (staccato-shot-tone-related rendition style module), where "HA" represents a train of representative points (e.g., point 1 and point 2) of the harmonic component's amplitude vector, "HP" represents a train of representative points (e.g., point 1 and point 2) of the harmonic component's pitch vector and "HT" represents an example of the harmonic component's waveform shape vector (the waveform is schematically shown by its envelope alone). Specifically, the harmonic component's waveform shape vector HT comprises sample data that represent a full waveform of the whole of a tone made up basically of a rise and fall portions, which includes a loop waveform segment between the rise and fall portions of the tone. By reading out the loop waveform segment in a repeated fashion (namely, by loop readout of the loop waveform segment), the staccato waveform represented by the staccato-shot-tone-related rendition style module can be stretched a little in the time-axial direction to make desired time adjustment. Parameter "preBlockTime", defining a start time of the harmonic component in the staccato shot tone, is indicative of a difference between an actual tone-generation start time and a waveform-generation start time of the harmonic component of a staccato waveform. Specifically, at that time, a note-on event paired with the start time is obtained to determine an actual tone-generation start time (note-on time (noteOnTime) in FIG. 6), and a difference between the note-on time (noteOnTime) and the pre-block time (preBlockTime) (i.e., noteOnTime−preBlockTime) is set as a staccato-shot-tone start time (startTime) of the harmonic component.

Of parameters defining end times of the harmonic component in the staccato shot tone, a post-block time parameter (postBlockTime) defines a difference between an actual tone-generation start time and a body-waveform end time of the harmonic component of a staccato waveform. Thus, an end time (endTime) of the harmonic component in the staccato shot tone can be determined as a sum "note-on time (noteOnTime)+post-block time (postBlockTime)". This end time (endTime) is returned to the rendition style synthesis section 101B as data defining a module start time of the harmonic component of a next rendition style event. In this manner, the rehearsal process is carried out for setting a start time of the harmonic component of the next rendition style module in accordance with the end time (endTime) of the harmonic component.

Part (b) of FIG. 6 illustratively show various vectors of the nonharmonic component in the staccato shot tone (staccato-tone-related rendition style module), where "NHA" represents a train of representative points (e.g., point 1 and point 2) of the nonharmonic component's amplitude vector and "NHT" represents an example of the nonharmonic component's waveform shape vector (the waveform is schematically shown by its envelope alone). Parameter "preTimeNH", defining a start time of the nonharmonic component in the staccato shot tone, is indicative of a difference between an actual tone-generation start time and a waveform-generation start time of the nonharmonic component of a staccato waveform. Specifically, at that time, a note-on event paired with the start time is obtained to determine an actual tone-generation start time (note-on time (noteOnTime) in FIG. 6), and a difference between the note-on time (noteOnTime) and the pre-time (preTimeNH) (i.e., noteOnTime−preTimeNH) is set as a staccato-shot start time (startTime) of the nonharmonic component, in a similar manner to the start time setting of the harmonic component.

Post-time parameter (postTimeNH), which defines an end time of the nonharmonic component in the staccato shot tone, defines a difference between an actual tone-generation start time and an end time of the nonharmonic component of the staccato waveform. Thus, an end time (endTimeNH) of the nonharmonic component in the staccato shot tone can be determined as a sum "note-on time (noteOnTime)+post-time (postTimeNH)". This end time (endTimeNH) is returned to the rendition style synthesis section 101B as data defining a module start time of the nonharmonic component of a next rendition style event. In this manner, the rehearsal process is carried out for setting a start time of the nonharmonic component of the next rendition style module in accordance with the end time (endTimeNH) of the nonharmonic component. As readily seen from the foregoing, the time adjustment of the nonharmonic component is executed independently of the time adjustment of the harmonic component.

Note that in the case where the above-described waveform production apparatus is applied to an electronic musical instrument, the electronic musical instrument may be of any other type than a keyboard instrument, such as a stringed, wind or percussion instrument. In such a case, the present invention is of course applicable not only to such an electronic musical instrument where all of the performance synthesis section 101A, rendition style synthesis section 101B, waveform synthesis section 101C, etc. are incorporated together as a unit within the musical instrument, but also to another type of electronic musical instrument where the above-mentioned sections are provided separately and interconnected via communication facilities such as a MIDI interface, network and/or the like. Further, the waveform production apparatus of the present invention may comprise a combination of a personal computer and application software, in which case various processing programs may be supplied to the waveform production apparatus from a storage media, such as a magnetic disk, optical disk or semiconductor memory, or via a communication network. Furthermore, the waveform production apparatus of the present invention may be applied to automatic performance apparatus such as a player piano.

In summary, the present invention arranged in the above-described manner can readily produce, in a simplified manner and with ample controllability, a characteristic tone having rendition styles (or articulation) of its attack and release portions closely related each other, by preparing in advance not only normal rendition style modules, such as attack-, release-, body- and joint-related rendition style modules, to be used for producing normal tones but also shot-tone-related rendition style modules, each integrally including attack and release waveforms, to be used for production of characteristic tones different from normal tones.

The present invention relates to the subject matter of Japanese Patent Application Nos. 2002-041175 filed on Feb. 19, 2002, disclosure of which is expressly incorporated herein by reference in its entirety.

What is claimed is:

1. A waveform production apparatus for time-serially combining a plurality of rendition style modules and thereby producing a continuous tone waveform having rendition style characteristics corresponding to the combined rendition style modules, said waveform production apparatus comprising:

a memory storing a plurality of rendition style modules, said memory storing at least a shot-tone-related rendition style module integrally including characteristics of an attack portion and release portion in association with a predetermined rendition style; and a processor coupled with said memory and adapted to:

select the shot-tone-related rendition style module from said memory, in order to produce a tone waveform having a characteristic of the predetermined rendition style;

read out, from said memory, two or more rendition style modules including the selected shot-tone-related rendition style module and allot the read-out rendition style modules to a time axis; and produce a continuous tone waveform on the basis of the rendition style modules allotted to the time axis.

2. A waveform production apparatus as claimed in claim 1 wherein said processor selects the shot-tone-related rendition style module on the basis of predetermined information included in performance data.

3. A waveform production apparatus as claimed in claim 2 wherein the predetermined information is information designating a duration of a tone.

4. A waveform production apparatus as claimed in claim 1 which further comprises a setting section that sets a condition for determining whether or not the shot-tone-related rendition style module should be used, and wherein, when a tone to be generated satisfies the condition set by said setting section, said processor selects and uses the shot-tone-related rendition style module.

5. A waveform production apparatus as claimed in claim 1 which further comprises a setting section that, when a plurality of tones corresponding to the predetermined rendition style are to be generated in succession, sets, as a parameter, order of the plurality of tones, and wherein said memory stores a plurality of different shot-tone-related rendition style modules in association with the predetermined rendition style, and when a plurality of tone waveforms corresponding to the predetermined rendition style are to be produced in succession, said processor, in accordance with the parameter set by said setting section, selects different shot-tone-related rendition style modules and allocates the selected different shot-tone-related rendition style modules to respective tones in such a manner that, for the plurality of tones corresponding to the predetermined rendition style, no same shot-tone-related rendition style module is allocated successively to two or more of the tones.

6. A waveform production apparatus for time-serially combining a plurality of rendition style modules and thereby producing a continuous tone waveform having rendition style characteristics corresponding to the combined rendition style modules, said waveform production apparatus comprising:

a memory storing a plurality of rendition style modules, said memory storing at least a shot-tone-related rendition style module integrally including characteristics of an attack portion and release portion, an attack-related rendition style module having a characteristic of an attack portion and a release-related rendition style module; and a processor coupled with said memory and adapted to:

select whether the shot-tone-related rendition style module should be used or a combination of the attack-related rendition style module and release-related rendition style module should be used, in order to produce a tone waveform having an attack portion and release portion;

read out, from said memory, two or more rendition style modules including the selected rendition style module and allot the read-out rendition style modules to a time axis; and produce a continuous tone waveform on the basis of the rendition style modules allotted to the time axis.

7. A waveform production apparatus as claimed in claim 6 wherein said processor selects the shot-tone-related rendition style module on the basis of predetermined information included in performance data.

8. A waveform production apparatus as claimed in claim 7 wherein the predetermined information is information designating a duration of a tone.

9. A waveform production apparatus as claimed in claim 6 which further comprises a setting section that sets a condition for determining whether or not the shot-tone-related rendition style module should be used, and wherein, when a tone to be generated satisfies the condition set by said setting section, said processor selects and uses the shot-tone-related rendition style module.

10. A waveform production apparatus as claimed in claim 6 which further comprises a setting section that, where a plurality of tones corresponding to the predetermined rendition style are to be generated in succession, sets, as a parameter, order of the plurality of tones, and wherein said memory stores a plurality of different shot-tone-related rendition style modules in association with the predetermined rendition style, and when a plurality of tone waveforms corresponding to the predetermined rendition style are to be produced in succession, said processor, in accordance with the parameter set by said setting section, selects different shot-tone-related rendition style modules and allocates the selected different shot-tone-related rendition style modules to respective tones in such a manner that, for the plurality of tones corresponding to the predetermined rendition style, no same shot-tone-related rendition style module is allocated in succession to two or more of the tones.

11. A waveform production method for time-serially combining a plurality of rendition style modules and thereby producing a continuous tone waveform having rendition style characteristics corresponding to the combined rendition style modules, a shot-tone-related rendition style module including characteristics of an attack portion and release portion being stored in a memory in association with a predetermined rendition style, said waveform production method comprising:

selecting the shot-tone-related rendition style module from said memory, in order to produce a tone waveform having a characteristic of the predetermined rendition style;

reading out, from said memory, two or more rendition style modules including the shot-tone-related rendition style module selected by the step of selecting, and allotting the read-out rendition style modules to a time axis; and producing a continuous tone waveform on the basis of the rendition style modules allotted to the time axis.

12. A waveform production method for time-serially combining a plurality of rendition style modules and thereby producing a continuous tone waveform having rendition style characteristics corresponding to the combined rendition style modules, at least a shot-tone-related rendition style module integrally including characteristics of an attack portion and release portion, an attack-related rendition style module having a characteristic of an attack portion and a release-related rendition style module being stored in a memory, said waveform production method comprising:

selecting whether the shot-tone-related rendition style module should be used or a combination of the attack-related rendition style module and release-related rendition style module should be used, in order to produce a tone waveform having an attack portion and release portion;

reading out, from said memory, two or more rendition style modules including the selected rendition style module, and allotting the read-out rendition style modules to a time axis; and producing a continuous tone waveform on the basis of the rendition style modules allotted to the time axis.

13. A computer program containing a group of instructions for causing a computer to perform the method recited in claim 11.

14. A computer program containing a group of instructions for causing a computer to perform the method recited in claim 12.

* * * * *